US005472743A

United States Patent [19]

Daluise

[11] Patent Number: 5,472,743

[45] Date of Patent: Dec. 5, 1995

[54] METHOD AND APPARATUS FOR APPLYING RESILIENT ATHLETIC SURFACES

[76] Inventor: Daniel A. Daluise, 11 Skylar Dr., Southboro, Mass. 01772

[21] Appl. No.: 288,463

[22] Filed: Aug. 10, 1994

Related U.S. Application Data

[63] Continuation-in-part of Ser. No. 111,189, Aug. 24, 1993, which is a continuation of Ser. No. 894,084, Jun. 5, 1992, abandoned.

[51] Int. Cl.[6] ..... B05D 1/34

[52] U.S. Cl. ..... 427/426; 427/136; 427/196; 427/197; 118/300; 118/308

[58] Field of Search ..... 427/426, 196, 427/197, 136; 118/300, 308; 239/430, 432, 549, 553.5, 558, 590, 416.5, 424, 425.5

[56] References Cited

U.S. PATENT DOCUMENTS

| | | | |
|---|---|---|---|
| 2,025,974 | 12/1931 | Fritz | 91/44 |
| 3,676,198 | 5/1970 | McGroarty | 117/105.5 |
| 4,281,496 | 8/1981 | Danielsson | 52/612 |
| 4,411,389 | 10/1983 | Harrison | 239/427.5 |
| 4,420,513 | 12/1983 | Coke et al. | 427/407.1 |
| 5,320,870 | 6/1994 | Sorathia et al. | 427/385.5 |

OTHER PUBLICATIONS

Allentown Pneumatic Gun, Inc. brochure; Dry Process; pp. 1–5.

Airplaco brochure; C–7 Rotary Gunite Machine; 2–Pages no date.

Allentown Pneumatic Gun, Inc. brochure; GRH 600 Rotary Gun; 2–Pages.

Allentown Pneumatic Gun, Inc. brochure; Specifications; pp. 1–32 no date.

Sprintrax brochure; booklet no date.

*Primary Examiner*—Shrive Beck
*Assistant Examiner*—David M. Maiorana
*Attorney, Agent, or Firm*—Nields & Lemack

[57] ABSTRACT

A method and apparatus for continuously coating particulate such as rubber with liquid binder and applying the same to a substrate to form resilient athletic surfaces. Total encapsulation of the particulate with the liquid binder is accomplished prior to applying the mix to the substrate. In addition, the method of delivery of the particulate and binder maintains the ratios thereof uniform. In its method aspects, the instant invention involves separately introducing a stream of particulate and a stream of binder into a spray nozzle, where they are combined and delivered to the substrate. The apparatus includes a nozzle assembly having a central lumen and an elongated tip, the lumen being formed so as to force the particulate introduced therein to follow a circuitous or indirect path therethrough and thereby decrease its velocity prior to being ejected from the nozzle.

14 Claims, 2 Drawing Sheets

METHOD AND APPARATUS FOR APPLYING RESILIENT ATHLETIC SURFACES

This application is a continuation-in-part of application Ser. No. 08/111,189 filed Aug. 24, 1993, which is a continuation of application Ser. No. 07/894,084 filed Jun. 5, 1992, abandoned.

BACKGROUND OF THE INVENTION

This invention pertains to a method and apparatus for applying resilient surfaces to be used for running tracks, tennis courts, playgrounds, jogging paths, ballfield warning tracks and other activity areas requiring resilience.

Many materials and methods of application have been used to produce all-weather surfaces for the aforementioned uses, including pre-manufactured and in situ types. These systems typically involve a mixture of rubber granules, which provide resilience and traction, and a liquid binder, which hardens or cures and thereby holds the rubber particles in a solid matrix.

Pre-manufactured products are expensive and difficult to install. Indeed, the installation of pre-manufactured products inevitably results in many seams or joints which can fail in outdoor use. Accordingly, most installations of all-weather surfaces have been of the in situ (formed on site) type. Currently, there are two basic methods of in situ installation, commonly referred to as "dry" and "wet" applied.

The wet application process involves mixing rubber particulate with liquid binder in a mixer at specific ratios and batch sizes (usually at a ratio, by weight, of 60% binder, 40% rubber). The resulting slurry is spread onto the area to be surfaced by hand or mechanical means. This application is usually done in multiple layers when using latex binder and in one mechanically paved layer when using urethane binders. With respect to the latter, the application is typically accomplished by means of a track driven paving machine with an oscillating oil heated screed. This installation method creates paving joints or seams approximately every eight feet, as well as transverse joints approximately every 100 to 200 feet. These joints are not only aesthetically objectionable, they also create weak links in the system which are subject to premature failure. To cover these joints and seams, multiple structural sprays are usually applied to paved base mat polyurethanes. However, this method is limited to a maximum particle size of approximately 2 mm, and requires a high ratio of binder. Attempts have been made to use this method with latex binders, however there is a tendency for the rubber to separate from the liquid and clog the hose. Moreover, even with latex binders the particle size is limited to a maximum of 2 mm. With rubber particle sizes larger than 2 mm, the velocity of the rubber exiting the tip of the spray nozzle was such that the rubber "bounced" when impacting the substrate, thereby separating the rubber from the liquid binder. Moreover, such small particle sizes means that surface thickness cannot be built up to typically required depths without intolerable cost in terms of time and materials, and without un acceptable loss of resilience and porosity in the resulting surface. Stated differently, one could spray apply a track surface to typical thickness (⅜ or ½") using rubber particles of less than 2 mm, but such a process would not be economically feasible. Hence, this method is inappropriate for surfaces with greater than 2 mm in depth because of the man-hours required for application of thicker surfaces. In addition, the rubber and binder are mixed in a hopper, and unless conveyed to the site of application promptly, may set prematurely either in the hopper, the hose, or the spray nozzle.

The structural spray coats are the standard method of adding color to this type of track surface. Structural spray coats consist of 0.5 to 1.5 mm EPDM rubber, polyurethane binder and color pigmentations. However, this surface traditionally shows premature shadowing (signs of "black through"). This shadowing occurs because the structural spray can only be applied in limited thicknesses or it will choke the surface creating problems of adhesion and delamination. Thus, these structural sprays are generally applied to a maximum of 2 mm thickness with 0.5 to 1.5 mm rubber.

Conventionally the most common method for applying latex tracks is called the "rake and spray" or "dry" method. This process involves simply evenly raking out a layer of dry rubber granules onto the track base and then spraying over the granulate with a latex binder. This process is repeated with successive layers of rubber until a desired thickness is reached.

Although this method provides a more affordable athletic surface than polyurethane surfaces, is seamless, and does not require heavy investment in equipment, it is flawed in several major respects:

1. The method depends totally on the applicator to assume that a uniform ratio of rubber to binder is maintained. This is extremely difficult, since it requires the applicators to spread rubber by hand at the same poundage per unit area at all points on the surface, and then requires that the sprayer of the liquid binder applies exactly the same volume of liquid to each unit area. Improper application renders surfaces installed by this method prone to inconsistent results which are manifested in weak or easily abraded areas of the surface.

2. The method relies on migration by gravity of the liquid binder through the rubber granules in order to accomplish encapsulation of all the rubber particles. The ability or extent of migration can vary significantly, however, with the poundage of rubber applied per unit area and with the sizing or gradation of the rubber. For example, the presence of more fines will greatly inhibit migration. Since the recycled ground rubbers used in a running track surface vary dramatically from load to load or even from bag to bag, migration and therefore encapsulation can vary greatly.

3. Latex binder does not have the same physical properties as polyurethane binder. Its resilience is more effected by temperature, which means the majority of latex track surfaces are very hard during track season (February through mid May). In addition, latex binder is very susceptible to moisture during curing, which causes unraveling and delamination.

This "rake and spray" method of the prior art tends to pack the rubber tightly, which means more rubber and therefore more binder is necessary for a given thickness.

The wet and dry methods of application each have the further disadvantage of being labor intensive and time consuming.

In view of the added difficulties associated with the dry application method, various attempts have been made to devise continuous wet application methods rather than batch for both latex and urethane binder systems.

SUMMARY OF THE INVENTION

The problems of the prior art have been solved by the instant invention, which provides a method and apparatus for coating particulate material such as rubber with liquid binder and applying the same to a substrate in a continuous mix operation without the need to mix individual batches of rubber and binder. Total encapsulation of the rubber particulate with the liquid binder is accomplished prior to applying the mix to the substrate. In addition, the method of delivery of the rubber and binder maintains the ratios thereof uniform; thus, the system is not prone to mechanical problems such as clogging.

In its method aspects, the instant invention involves separately introducing a stream of particulate and a stream of binder into a spray nozzle, where they are combined and delivered to the substrate.

The apparatus of the instant invention includes a nozzle assembly having a central lumen and an elongated tip, the lumen being formed so as to force the rubber particulate introduced therein to follow a circuitous or indirect path therethrough and thereby decrease its velocity prior to being ejected from the nozzle.

DETAILED DESCRIPTION OF THE INVENTION

One suitable rubber utilized in the instant invention is a terpolymer elastomer made from ethylene-propylene diene monomer (referred to hereinafter as "EPDM"), typically used when colored surfaces are desired. It will be understood by those skilled in the art that any suitable rubber or resilient particulate can be used, depending on the application. For example, other particulate material suitable for use in the present invention includes ground tire rubber (SBR) and resilient plastics. Where multiple layers are applied, each layer need not be comprised of the same particulate material.

The binder system also depends on the application, and can be any liquid system capable of forming a bond with the particulate, such as an asphalt emulsion, urethane system, latex system, or any combination thereof. For example, suitable binders include carboxylated styrene butadiene latex, styrene-acrylic copolymer latex, acrylic latex, vinyl acrylic latex, water-borne urethane (aromatic and aliphatic), diphenylmethane diisocyanate-urethane (MDI), and toluene diisocyanate (TDI). Suitable surfaces which are a combination of particulate and binder are exemplified by those commercially available from Sprintrax under the Sprint 200®EA (a carboxylated styrene butadiene latex based surface), Sprint 200®E, Sprint 200® (an acrylic co-polymer based surface), Sprint 300™ (MDI) and Sprint 400™, Sprint 2000 Supreme (water-borne urethane) and Sprintcote series.

The surface to be constructed in accordance with the present invention is typically applied to an existing asphalt or concrete base.

Figure 1:
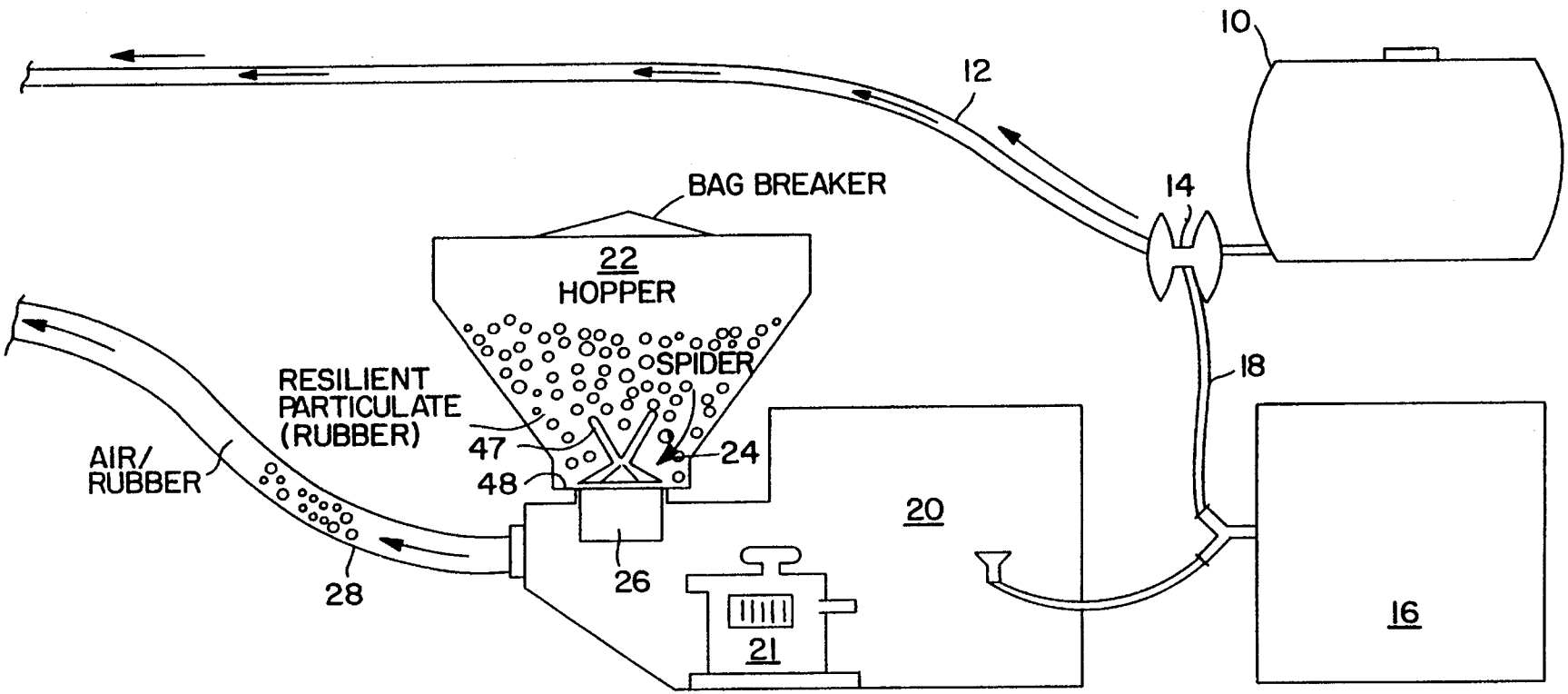
FIG. 1 is a partial diagrammatic view of the apparatus used in accordance with the present invention.

Turning now to FIG. 1, there is shown apparatus to be used in accordance with the instant invention. The apparatus is a modification of conventional equipment typically used for the application of GUNITE, such as the GRH 600 Rotary Gun commercially available from Allentown Pneumatic Gun, Inc.

Figure 2:
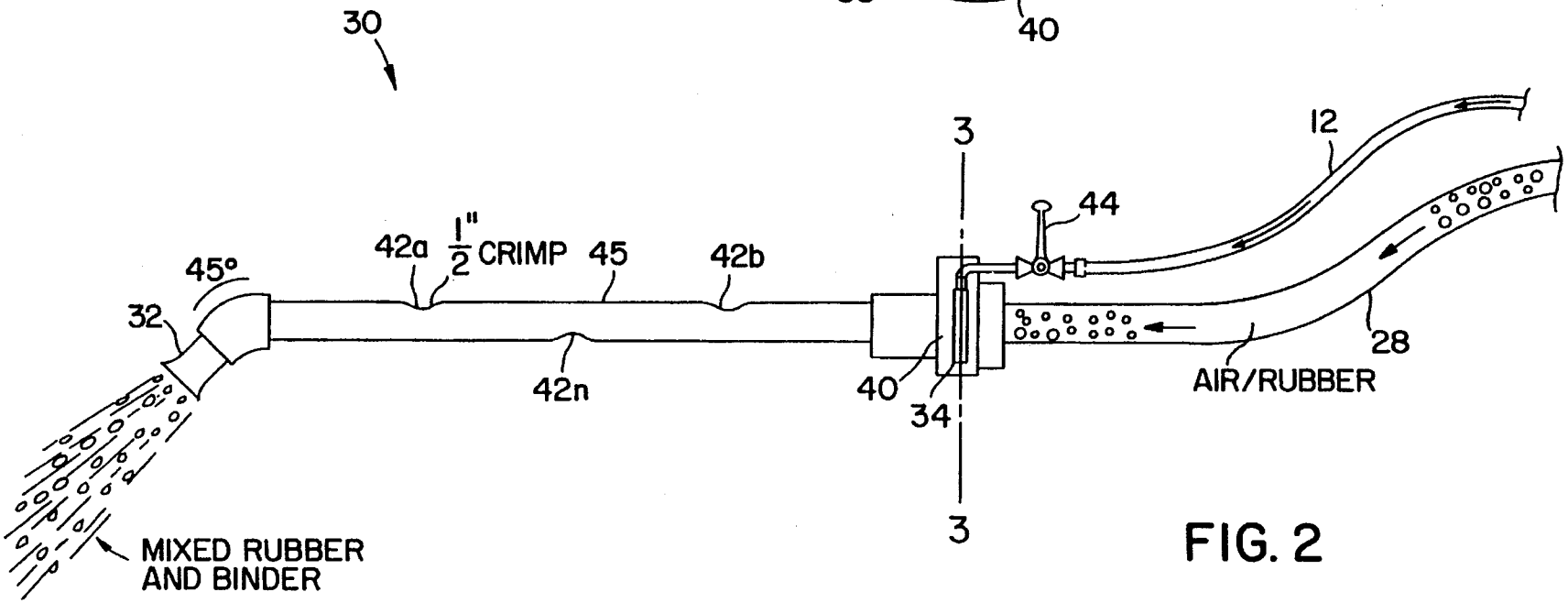
FIG. 2 is a side view of the nozzle assembly used in accordance with the present invention.

Liquid binder is stored in holding tank 10 of suitable size. Suitable liquid binder feed hose, such as ¾" I.D. rubber hose 12 is connected to tank 10 and is in communication with the nozzle 30 (FIG. 2). Pump 14, which can be any suitable type typically available for the purpose of pumping the type of liquid binder being used, such as an air actuated or motor driven pump, is attached to the hose 12 and produces sufficient pressure to convey the liquid binder to the nozzle 30. In the case of an air actuated pump, a compressor 16 of suitable capacity (185 cfm as been found to be appropriate) and an air line 18 associated therewith and with the pump 14 is used.

The compressor 16 also can be used to drive and provide transport air for the rotary gun/hopper assembly 20. The hopper 22 is of suitable capacity to hold sufficient rubber particulate, preferably in excess of 250 pounds of rubber particulate. The hopper 22 preferably includes a bag breaker, as the rubber material is typically packaged in a paper bag. A spider 24 comprising a vertical rod (not shown) with small horizontal or angled arms 47 projecting into the hopper chamber is attached perpendicular to the feed hole 48 and is caused to rotate within the hopper 22 by a rotor 26 driven by motor 29 in the rotary gun. Operation of the spider 24 helps prevent bridging, blocking and/or agglomeration of the rubber in the hopper 22 and breaks up any agglomerations of particulate than may have formed. The spider 24 also helps in continuously feeding the rubber particulate through a rotating manifold or rotor 26 which distributes the particulate evenly into an air stream. The air stream may be produced by any suitable means, such as by a blower or air compressor. Where an air compressor is used, it can be the same compressor used to actuate air pump 14. The particulate is transported by the air stream through a hose 28 to the nozzle 30. A hose having an internal diameter of 1.25 inches has been found to be suitable for transporting the rubber particulate in the air stream to the nozzle 30.

Figure 3:
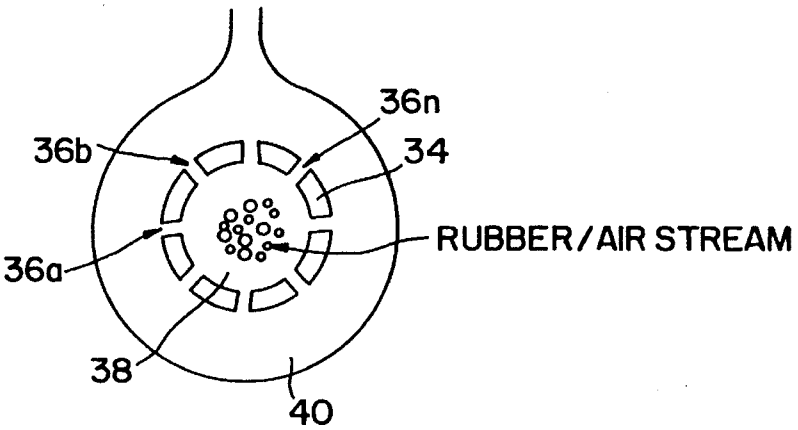
FIG. 3 is a cross-sectional view of the dispersing ring of the nozzle assembly along lines A—A of FIG. 2.

Turning now to FIG. 2, there is shown a nozzle 30 which includes a conduit portion 45 and a nozzle head 32 at a distal end of the conduit portion 45, the head 32 being positioned at about a 45° angle with respect to the conduit portion. A suitable internal diameter of the conduit portion 45 is 1.25 inches. A dispersing ring 34 (best seen in FIG. 3) is located at the proximal end of the nozzle 30. A plurality of circumferential orifices **36*a*–36*n* are formed in the dispersing ring 34, with eight evenly spaced orifices each having a diameter of ¼" being preferred, although it should be understood by those skilled in the art that the size and number of the orifices depends on the viscosity of the liquid binder being used. The hose 28 is coupled to the proximal end of the nozzle 30, and the air stream conveying the rubber is introduced into the nozzle 30 and flows through the central lumen 38 of the dispersing ring 34. The liquid binder is pumped via feed hose 12 into the circular chamber 40 housing the dispersing ring 34 (FIG. 3). Pressure developed by the pump 14 forces the liquid binder through orifices 36*a*–36*n* in the dispersing ring 34, causing the binder to enter into the air stream carrying the rubber particulate. As the air stream carrying the particulate and binder flows toward the distal end of the nozzle 30**, the binder becomes uniformly dispersed in the air stream and ultimately the particulate becomes encapsulated by the binder.

Other means of introducing the binder into the rubber include the use of multiple spray heads (not shown) through which the binder is sprayed into the air stream carrying the rubber.

In order to reduce the velocity of the binder-coated rubber particulate exiting the nozzle head 32, and thereby reduce or prevent the particulate from bouncing when it impacts the substrate, the length of the nozzle 30 between the dispersing ring 34 and the end of the nozzle head 32 should exceed twelve inches. Preferably the length of the nozzle 30 is about 20 to about 32 inches long, most preferably at least about 24 inches long. The elongated nozzle 30 also results in additional contact and wetting of the particulate with the liquid binder, which in turn causes further encapsulation of the rubber particulate by the binder. In addition, in order to create a circuitous or indirect flow path as the air stream travels from the dispersing ring 34 to the nozzle head 32, crimps or pinches 42*a*–42*n* are formed in the wall of the nozzle 30 at various intervals along its length (three shown), which cause the particulate to bounce against the inner walls of the nozzle 30 and decelerate. In the embodiment where the conduit portion is 1.25 inches in diameter, crimps which extend ½" into the central lumen of the nozzle 30 defined by the conduit portion 45 have been found to be suitable.

The ratio of binder to rubber particulate can be regulated as desired by any suitable means, such as by increasing or decreasing the rate at which particulate is fed from the hopper 22 by increasing or decreasing the rotation speed of the feed manifold and spider. In addition, the rate of flow of the liquid binder can be regulated by any suitable means, such as by a ball or needle valve 44 located just before the proximal end of the nozzle 30. By properly setting these flow rates, the operator can spray a specified mixture of rubber and binder onto a substrate in a continuous fashion. Depending upon the curing characteristics of the binder being used, a surface can be applied by this method in one, two or more passes. Since the flow of liquid and rubber can be independently controlled, the ratio of rubber and binder therefore can be controlled at a constant rate. Those skilled in the art will recognize that the ratio of binder to rubber desired depends upon the desired characteristics of the surface. For latex-based surfaces, the preferred ratio is about 40% latex and 60% rubber. For urethane-based surfaces, the preferred ratio is about 22% urethane and about 78% rubber.

The regulation of each stream also allows other methods of application with the same machinery. For example, after the surface mat has been installed, it can be over-sprayed with binder alone (i.e., no rubber particulate) by simply turning off the particulate material feed mechanism. For example, a urethane overspray of about 1 lb/yard can be applied for added strength. Similarly, a surface could be installed by spraying binder with no rubber and then blowing rubber with no (or a small proportion of) binder into the wet or uncured binder, allowing each course to cure, and then repeating the process until enough courses are applied to achieve the desired thickness.

The instant method and apparatus also is not limited to any specific size of rubber particulate. This is so because the rubber particulate passes through the central lumen of the dispersing ring 34, not through small orifices. Only the liquid binder flows through small orifices. In addition, the particular rheology of the liquid is not critical to the transport of the rubber particulate, since the binder and particulate are transported to the nozzle 30 separately. Suitable particulate material has average particulate diameters ranging from about 0.5 to about 7 mm. More specifically, particulate material having average diameters in the range of 0.5–1.5 mm, 1–3 mm, 1–4 mm, 1–5 mm, 2–6 mm and 4–7 mm have all been found to be functional. In view of the relatively large particle diameter that can be used in the present invention, the required surface thickness can be achieved with a minimal number of layers (2 to 5) and with sufficient void ratios to allow for much greater yield of materials and significant improvements in resilience and porosity.

Since the binder and rubber particulate are not combined until the separate streams reach the nozzle, premature curing is eliminated. Since the rubber particulate in the hopper is not mixed with the binder therein, it can be stored in the hopper 22 without problematic premature curing.

An added benefit of the present invention is the ability to build surface thickness with lower density of rubber. The "rake and spray" method of the prior art tends to pack the rubber more tightly, which means more rubber and therefore more binder is necessary for a given thickness (about 15% more). Not only does a less dense mat yield greater resilience in the surface, it also reduces the cost of materials.

In a preferred embodiment of the present invention wherein urethane is the binder, in order to obtain a smoother surface, the surface is bullfloated after each layer is applied. Best results are obtained when the bullfloating is carried out within about 0.5 hours after spray application. The system can be successfully installed by bullfloating the last layer of rubber applied, the last two layers, the last three layers, or all of the layers of rubber. The best combination of aesthetic results and manpower efficiency is attained when the last three layers of rubber applied are bullfloated within 0.5 hours of spraying.

The primary reason that bullfloating is needed with the urethane binder and not when using latex binder is that the urethane binder is much more viscous, which tends to allow the rubber to form small "piles", wherein one rubber particle will set on top of another, or where small pyramid groupings of particles would form high points. This does not occur with low viscosity latex binders. The bullfloating breaks up these undesirable groupings or high spots and forces the rubber particles into the mat by the weight of the bullfloat.

Preferably the bullfloat employed is a 4 or 5 foot wide by 6 inch deep bullfloat with a 24 to 30 foot adjustable angle handle, commercially available from Allen Engineering Corporation and sold under the RAZORBACK name.

What is claimed is:

1. A method of applying a running track to a substrate, comprising:

introducing a first stream into a nozzle, said first stream comprising a particulate material having an average particle size greater than 2 mm;

separately introducing a second stream into said nozzle, said second stream comprising a urethane binder for said particulate material;

causing said first and second streams to combine in said nozzle;

dispensing said combined streams from said nozzle onto said substrate to form a first surface layer of said running track;

allowing said first surface layer to set;

introducing a third stream into a nozzle, said third stream comprising a particulate material having an average particle size greater than 2 mm;

separately introducing a fourth stream into said nozzle, said fourth stream comprising a urethane binder for said particulate material;

causing said third and fourth streams to combine in said nozzle;

dispensing said third and fourth combined streams from said nozzle onto the set first surface layer to form a second surface layer of said running track; and bullfloating said second surface layer in order to provide a smooth running track surface.

2. The method of claim 1 wherein said first stream is introduced into said nozzle pneumatically.

3. The method of claim 1 wherein said nozzle comprises a dispersing ring, said dispersing ring comprising a central lumen and a plurality of circumferential orifices about said central lumen, and wherein said first stream is conveyed through said central lumen.

4. The method of claim 3 wherein said second stream is combined with said first stream by passing said second stream through said plurality of circumferential orifices in said dispersing ring, said plurality of circumferential orifices being in communication with said central lumen.

5. The method of claim 1 wherein said combined streams are dispensed from said nozzle by spraying.

6. The method of claim 1 wherein said first and second streams are introduced into said nozzle continuously.

7. The method of claim 1 wherein said particulate material is selected from the group consisting of EPDM and SBR.

8. The method of claim 1, further comprising bullfloating said first surface layer prior to allowing said first surface layer to set.

9. A method of applying a running track to a substrate, comprising:

providing a nozzle having a proximal end, a distal end and a conduit portion therebetween;

transporting a first stream of particulate material having an average particle size greater than 2 mm to said proximal end of said nozzle by way of a first air stream;

separately transporting a second stream of urethane binder for said particulate material to said proximal end of said nozzle;

introducing said second stream of urethane binder into said first air stream;

conveying said resulting first air stream of binder and particulate material through said conduit portion while decelerating the flow rate of said air stream;

dispensing said first air stream from said distal end of said nozzle onto said substrate selected from the group consisting of asphalt and concrete to form a first surface layer of said running track;

allowing said first surface layer to set;

transporting a third stream of particulate material having an average particle size greater than 2 mm to said proximal end of said nozzle by way of a second air stream;

separately transporting a fourth stream of urethane binder for said particulate material to said proximal end of said nozzle;

introducing said fourth stream of urethane binder into said second air stream;

conveying said resulting second air stream of binder and particulate material through said conduit portion while decelerating the flow rate of said second air stream;

dispensing said second air stream from said distal end of said nozzle onto the set first surface layer to form a second surface layer of said running track; and bullfloating said second surface layer in order to provide a smooth running track surface.

10. The method of claim 9 wherein said air stream is decelerated in said conduit portion by providing a circuitous flow path therein.

11. The method of claim 9 wherein said air stream is dispensed from said distal end of said nozzle by spraying.

12. The method of claim 9 wherein said first and second streams are transported to said nozzle continuously.

13. The method of claim 9 wherein said particulate material is selected from the group consisting of EPDM and SBR.

14. The method of claim 9, further comprising bullfloating said first surface layer prior to allowing said first surface layer to set.

* * * * *